US006364133B1

(12) United States Patent
Sheng

(10) Patent No.: US 6,364,133 B1
(45) Date of Patent: Apr. 2, 2002

(54) STACKABLE, ALL-PLASTIC MODULE FOR SUPPORTING HANGING FILE FOLDERS

(75) Inventor: Tony L. Sheng, Livingston, NJ (US)

(73) Assignee: Honeyware, Inc., Kearny, NJ (US)

( * ) Notice: Subject to any disclaimer, the term of this patent is extended or adjusted under 35 U.S.C. 154(b) by 0 days.

(21) Appl. No.: 09/366,888

(22) Filed: Aug. 4, 1999

(51) Int. Cl.[7] ..... A47F 7/16

(52) U.S. Cl. ..... 211/46; 211/189; 211/194; 312/184; 312/111

(58) Field of Search ..... 211/46, 189, 194; 312/184, 108, 111, 183, 193; 108/191, 101, 189

(56) References Cited

U.S. PATENT DOCUMENTS 3,241,885 A * 3/1966 Deaton ..... 297/440
3,281,193 A * 10/1966 Murray ..... 312/184
3,630,387 A * 12/1971 Wehner ..... 211/46 X
3,734,590 A * 5/1973 Ormiston et al. ..... 312/322
3,788,718 A * 1/1974 Bjorn et al. ..... 312/184
D295,098 S * 4/1988 Delmerico ..... D34/17
4,913,302 A * 4/1990 Stonier ..... 220/6
5,002,191 A * 3/1991 Herbst ..... 211/46
5,016,948 A * 5/1991 Welch et al. ..... 312/250
5,407,262 A * 4/1995 Christian et al. ..... 312/257.1
5,607,212 A * 3/1997 Kilpatrick ..... 312/237

* cited by examiner

*Primary Examiner*—Daniel P. Stodola
*Assistant Examiner*—Khoa Tran

(57) ABSTRACT

An all-plastic module forms a letter-by-legal frame in which file folders can hang. The module is assembled from two identical end pieces and two identical side pieces. Casters can be attached to the module so it can roll on a floor or a desktop. The modules can be stacked. A lid can be detachably secured to a module to prevent dust from settling on the file folders therein.

11 Claims, 5 Drawing Sheets

STACKABLE, ALL-PLASTIC MODULE FOR SUPPORTING HANGING FILE FOLDERS

BACKGROUND OF THE INVENTION

The invention relates to transportable file holders, and more specifically relates to transportable file holders of the letter-by-legal type. In its most immediate sense, the invention relates to transportable all-plastic letter-by-legal file holders that are inexpensive and suitable for light duty.

A transportable file holder stores file folders and can easily be moved from one location to another. Conventionally, the file holder has a cavity for the file folders and that cavity has letter-by-legal dimensions, i.e. is a rectangle that is slightly larger than 11" wide, 14" long, and 8.5" deep. This permits either letter-size or legal-size file folders to be stored. Letter-size file folders are stored in the transverse orientation; legal-size file folders are stored in the longitudinal orientation.

There is a need for a light-duty, letter-by-legal transportable file holder that would be inexpensive and suitable for use in e.g. a home office.

One object of the invention is to provide a light-duty, inexpensive file holder.

Another object is to provide such a holder that is made entirely of plastic and that consequently avoids the expense of metal parts.

Yet a further object is to provide such a holder that can be shipped and sold in unassembled form to save on shipping and storage costs, but that is nonetheless easy to assemble without tools.

Still a further object is, in general, to improve on known file holders of this general type.

In accordance with the invention, there is provided a set of parts that assembles into a module. The module is an open frame in which hanging file folders can be stored. When assembled, the frame has a letter-by-legal opening into which letter-size or legal-size hanging file folders can be inserted.

The modules in accordance with the invention can be stacked. As a result, it is possible to store many hanging file folders in a relatively small footprint.

Advantageously, and in accordance with the preferred embodiment, a caster can be secured to the lower end of each of the four legs of the module. This permits an entire stack of modules to be conveniently rolled from one location to another.

Further advantageously, and in accordance with the preferred embodiment, a plastic lid is provided. The lid can be hingedly secured to the module to close over the file folders hanging therein. This protects the file folders from dust, water, and other foreign objects that may soil or damage them. The lid can easily be removed, if desired.

Still further advantageously, and in accordance with the preferred embodiment, each module is made of two identical leg pieces and two identical side pieces. Each leg piece has two legs of the module, and the pieces are all connected together using plug-and-socket connections. As a result, the preferred embodiment can be shipped and sold unassembled to reduce the costs of shipping and storage. This has the further advantage that the preferred embodiment is easy to assemble and disassemble as required, that no tools are required for assembly or disassembly, and that assembly and disassembly are simple and obvious for most persons.

BRIEF DESCRIPTION OF THE DRAWINGS

The invention will be better understood with reference to the following illustrative and non-limiting drawings, in which.

DETAILED DESCRIPTION OF A PREFERRED EMBODIMENT

In the following description of preferred embodiments, the same element is always indicated by the same reference number. The drawings are not all to the same scale and parts thereof may be selectively enlarged for clarity.

Figure 1:
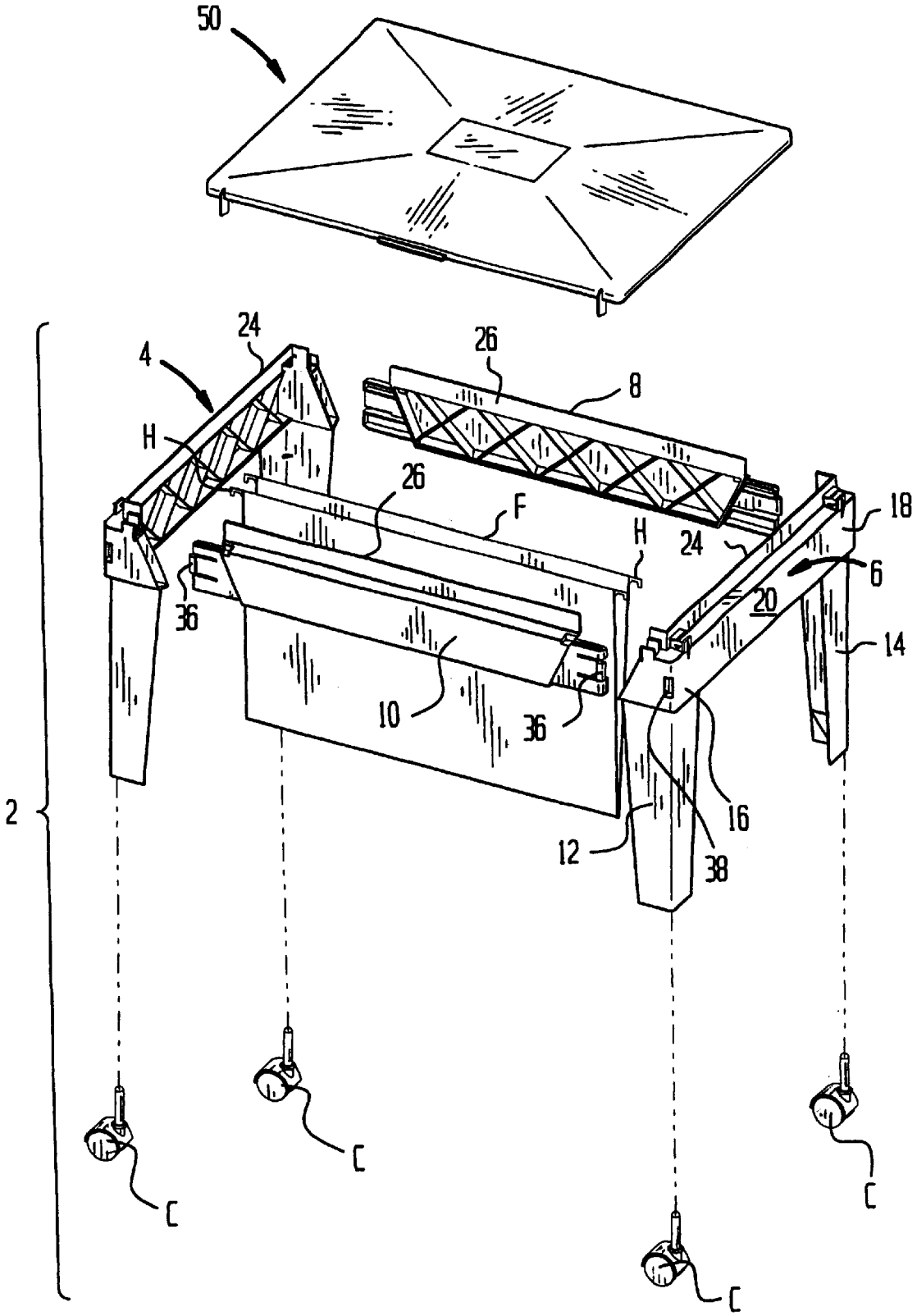
FIG. 1 shows an exploded view of a preferred embodiment of the invention.

FIG. 1 shows an open-centered file module generally indicated by reference number 2. The module 2 is formed by two leg pieces 4 and 6 and two side pieces 8 and 10. The leg pieces 4 and 6 are identical, as are the side pieces 8 and 10. The leg pieces 4 and 6, and the side pieces 8 and 10, are advantageously made of high impact polystyrene because of the strength and appearance of this material, but this is only preferred and another type of plastic can be used instead. Further advantageously, each of the leg pieces 4 and 6 and each of the side pieces 8 and 10 is a unitary piece made e.g. by injection molding, but this is not required.

Because the leg pieces 4 and 6 are identical, only leg piece 6 will be described specifically. The leg piece 6 has first and second legs 12 and 14. The legs 12 and 14 are identical. The legs 12 and 14 are connected to the ends 16 and 18 of a crosspiece 20. As can best be seen in FIG. 2, the leg 12, the leg 14, and the crosspiece 20 are each reinforced with struts 22 (FIG. 2) to resist deformation under load.

Each of the ends 16 and 18 of the crosspiece 20 is right angled, so that the leg pieces 4 and 6 and the side pieces 8 and 10 bound a rectangle when all four pieces are joined together as is described below. In the preferred embodiment, the rectangle has letter-by-legal dimensions, i.e. is slightly larger than 11 inches by 14 inches, and the legs 12 and 14 of the leg pieces 4 and 6 are dimensioned so that when the legs 12 and 14 are placed on a flat surface, the tops of the leg pieces 4 and 6 will be slightly higher than 8.5 inches above that surface. In this way, the module 2 forms a frame in which hanging file folders F (see FIG. 1) of either letter size (8.5 inches by 11 inches) or legal size (8.5 inches by 14 inches) can be hung.

Advantageously, the module 2 is dimensioned so that the 14 inch legal dimension is the spacing between the leg pieces 4 and 6 and the legal dimension is the spacing between the side pieces 8 and 10. (A legal size file folder F is shown in FIG. 1.) This reduces the size (and therefore the cost) of the mold (not shown) used to make the leg pieces 4 and 6. Further advantageously, a rail 24 is located at the top of each of the leg pieces 4 and 6, and a rail 26 is located at the top of each of the side pieces 8 and 10. The rails 24 and 26 are dimensioned so that the hooks H at the ends of a conventional hanging file folder F will engage them (see FIG. 1). This makes it easier to slide the file folders when they are suspended within the frame.

Figure 4:
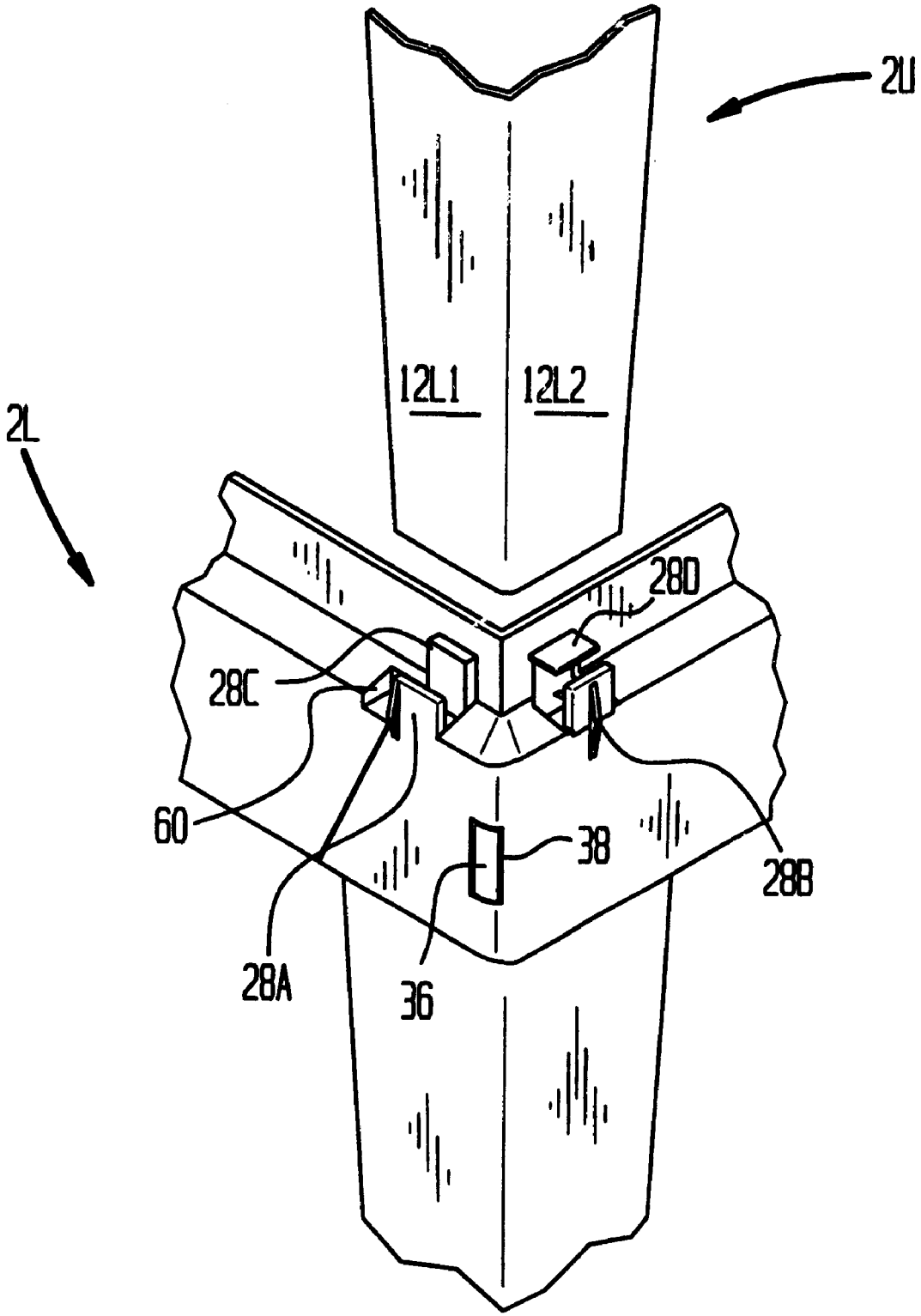
FIG. 4 shows a leg of an upper module (not otherwise shown) just before it engages an assembled corner of a lower module, in accordance with the preferred embodiment of the invention.

In accordance with the preferred embodiment, the module 2 is designed so the leg pieces 4 and 6 and the side pieces 8 and 10 lock together once they have been assembled. To do this, locking plug-and-socket connections are used. In the preferred embodiment, split plugs 30 are located at each end of each of the side pieces 8 and 10, and each plug 30 is received into a mating socket 32 at one of the ends 16, 18 of the crosspiece 20. In the center of each plug 30 is a deformable tongue 34 with an enlarged head 36 (FIGS. 1 and 4). When a plug 30 is being introduced into a socket 32, the head 36 is pushed inwardly, thereby deforming the tongue 34. Once the plug 30 has been fully introduced into the socket 32, the head 36 snaps into a recess 38 (FIGS. 1 and 4) in the crosspiece 20 as the tongue 34 returns to its undeformed state. This locks the side piece 8 or 10 into the leg piece 4 or 6 into which it has been inserted. The pieces will thereafter be locked together unless the head 36 is pushed inwardly while the side piece 8 or 10 and the leg piece 4 or 6 are being pulled apart.

Figure 2:
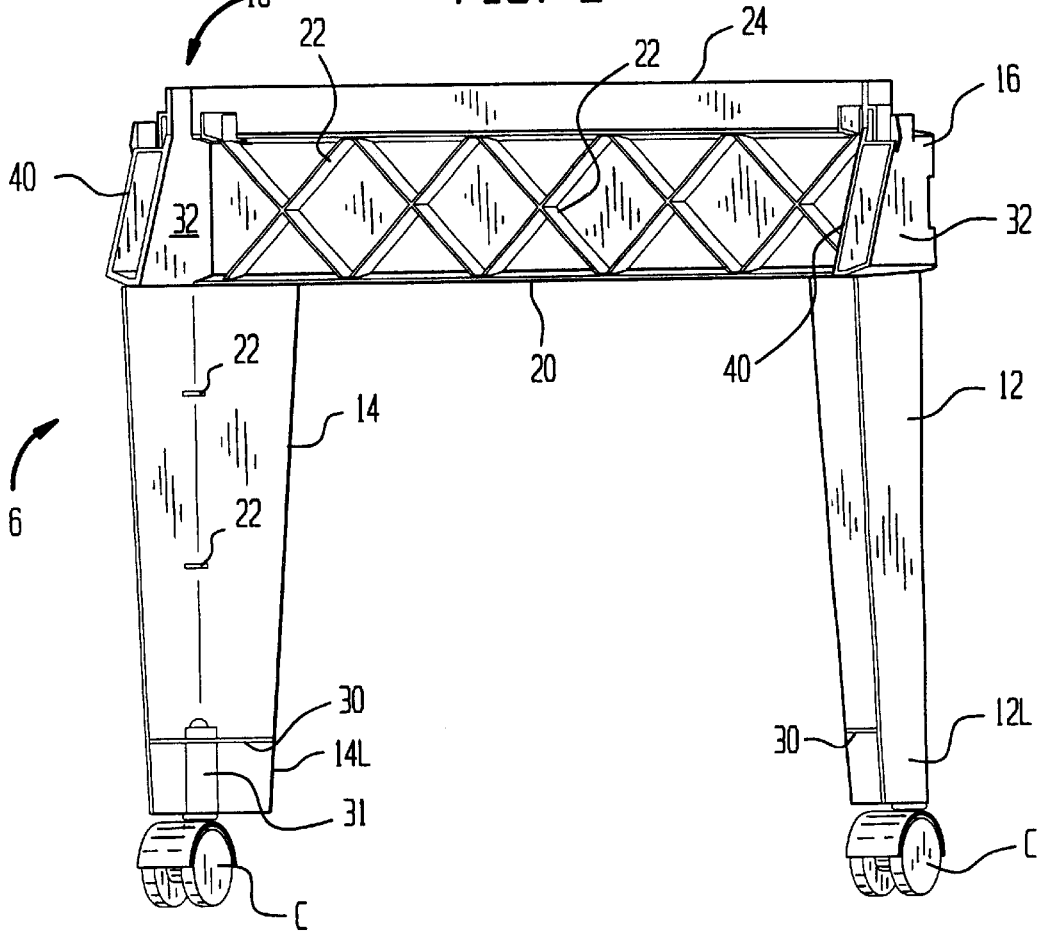
FIG. 2 is a view of one of the leg pieces in accordance with the preferred embodiment of the invention.
Figure 3:
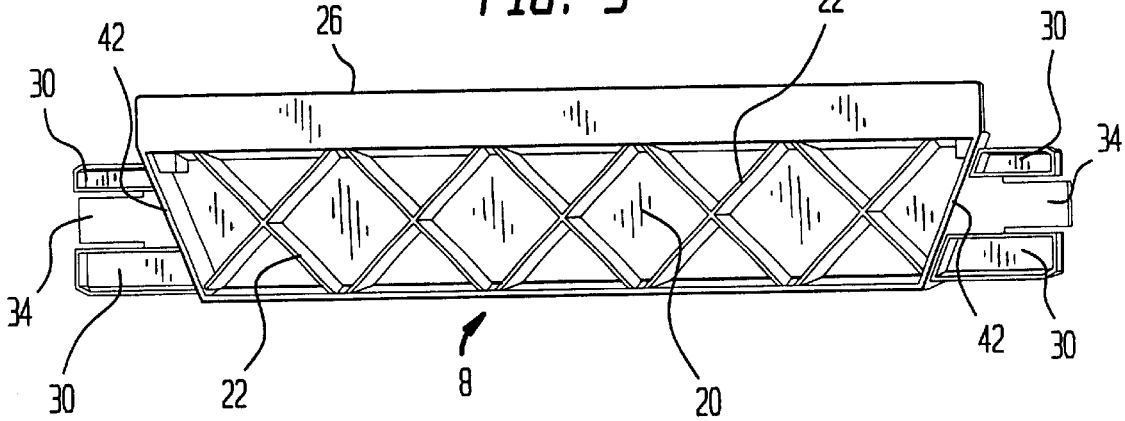
FIG. 3 is a view of one of the side pieces in accordance with the preferred embodiment of the invention.

As can be best seen in FIGS. 2 and 3, the sockets 32 have front openings 40 that are inclined with respect to the vertical, and the proximal ends 42 of the side pieces 8, 10 are likewise inclined with respect to the vertical. This keys the plugs 30 and the sockets 32 so that the plugs 30 can be inserted in only one way.

Although this locking plug-and-socket arrangement is preferred because of its simplicity and effectiveness, it is not required. Alternatively, other locking schemes may be used instead.

In accordance with the preferred embodiment, each of the legs 12 and 14 is capable of receiving a caster C at its lower end 12L or 14L. This makes it easier to roll the module 2 on any horizontal surface (such as a desktop or floor, not shown). Advantageously, this is done by using a triangular reinforcing brace 30 near the lower end 12L or 14L; the brace 30 supports a tube 31 into which the caster C can be inserted. A conventional caster C has a slightly enlarged head (not shown), which retains the caster C in the tube 31 once the caster C has been fully inserted therein.

Advantageously, the module 2 is designed so that one module can be stacked on top of another one (if, of course, no casters C are attached to the upper module). It is presently believed that a stack of modules 2 should not contain more than two modules 2. In accordance with the preferred embodiment, the ends 16, 18 of the crosspieces 20 are provided with means (discussed below) by which the lower ends 12L, 14L of the legs 12, 14 can engage with the ends 16, 18 of the crosspiece 20 of a leg piece 4 or 6. In the preferred embodiment, once an upper module 2U has been engaged with a lower module 2L, it cannot be horizontally displaced.

To accomplish this objective, each of the ends 16, 18 of each of the crosspieces has a group of flanges 28A, 28B, 28C, and 28D (FIG. 4A). Flanges 28A and 28B are at right angles to each other, and flanges 28C and 28D are located so that the flange 28C is opposed to the flange 28A and the flange 28D is opposed to the flange 28B.

As can best be seen in FIG. 4A, the flanges 28A, 28B, 28C, and 28D are so arranged that the lower end 12L of the leg 12 of an upper module 2U can fit into the group 28. When so fitted, flange 12L1 of the lower end 12L fits between flanges 28A and 28C and the flange 12L2 of the lower end 12L fits between flanges 28B and 28D. Consequently, while the upper module 2U can be can be lifted up for removal, it cannot be displaced horizontally with respect to the lower module 2L. This makes a stack of modules 2 more stable so that rolling the stack on a smooth floor or desk surface is unlikely to cause the stack to tip.

Advantageously, and in accordance with the preferred embodiment, a unitary plastic lid generally indicated by reference numeral 50 made of clarified polypropylene is detachably securable to the module 2. The lid 50, which is rectangular and is slightly larger than letter-by-legal size, prevents foreign matter (e.g. dust) from accumulating upon the file folder and files that are supported within the module 2. (If more than one module 2 has been stacked up in a stack, the lid 50 would be detachably secured to the uppermost module 2.)

Figure 5:
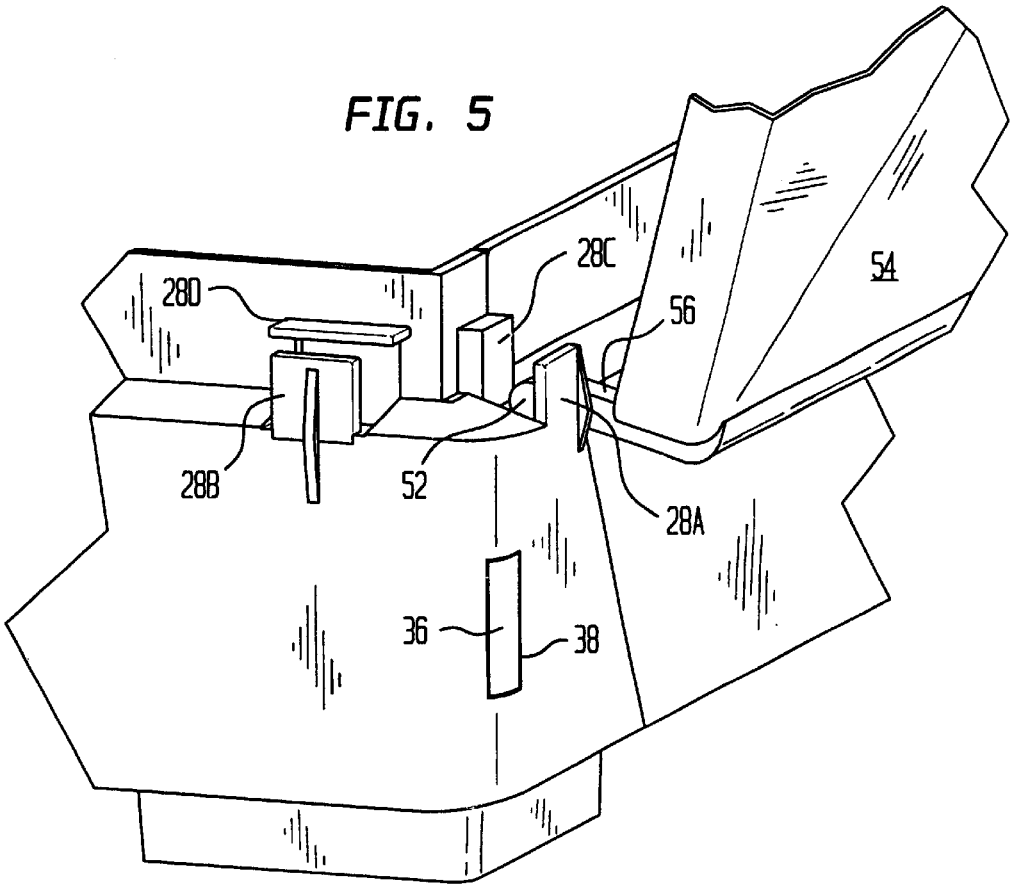
FIG. 5 is a detail view showing how the lid hinges engage an assembled module when the lid is open.
Figure 6:
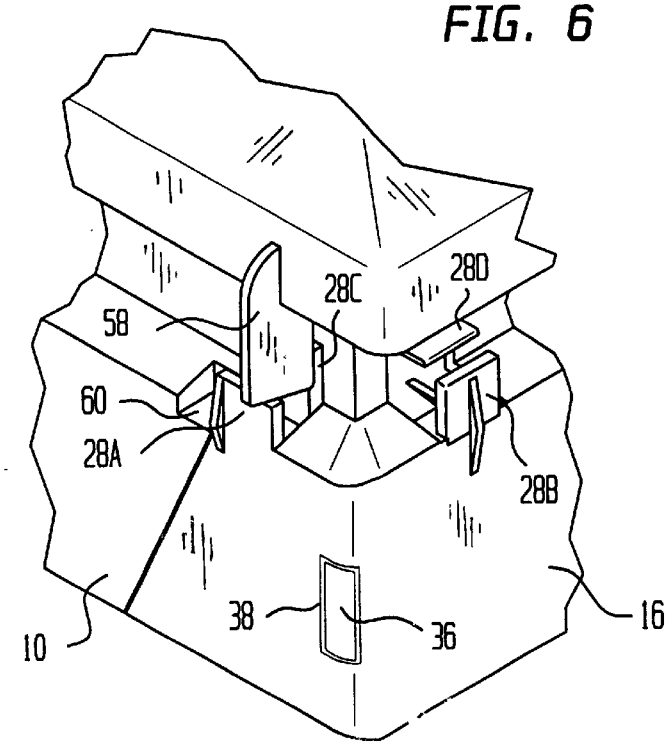
FIG. 6 is a detail view showing how the lid stop arms rest upon the assembled module when the lid is closed.
Figure 7:
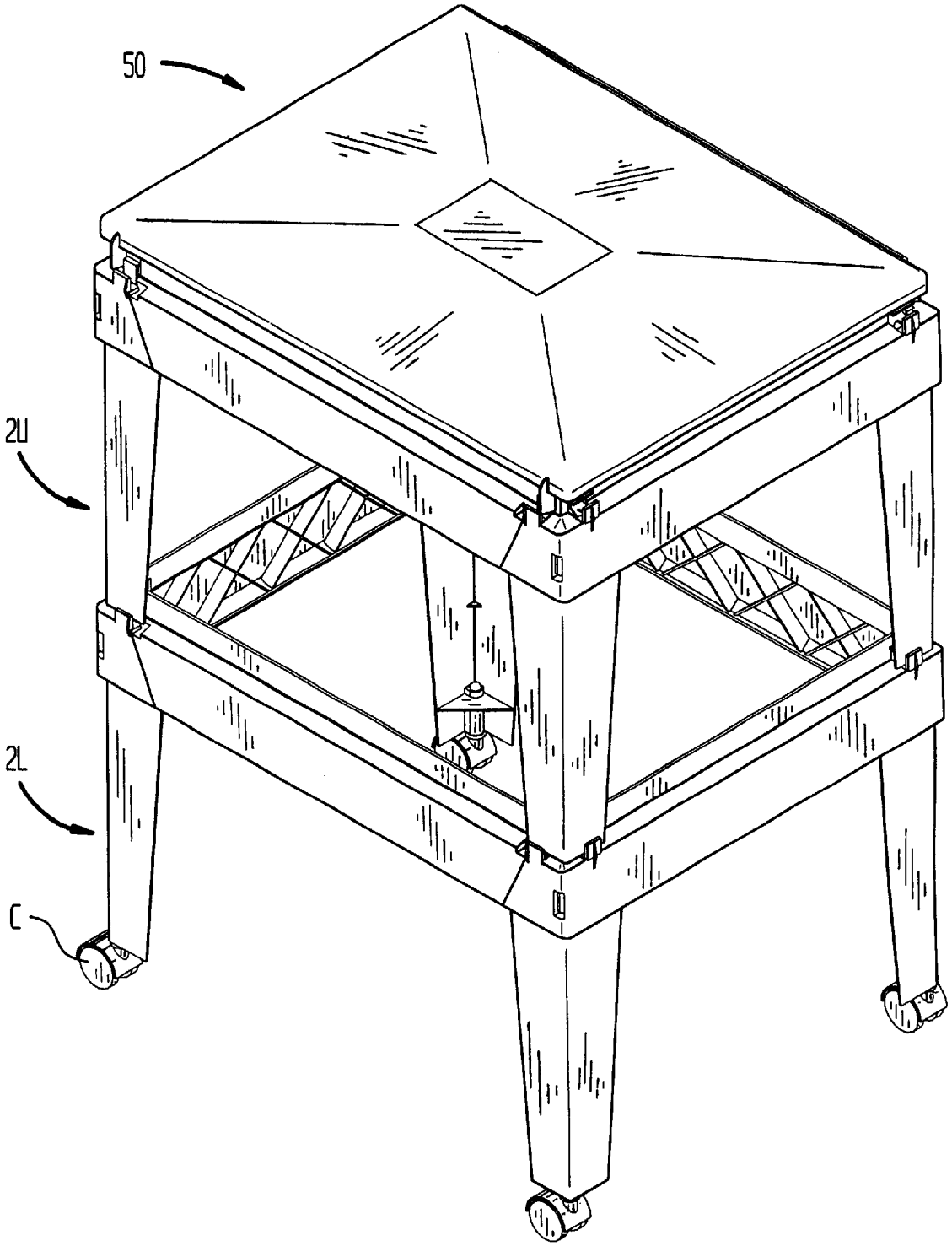
FIG. 7 shows an assembled view of two modules of the preferred embodiment stacked one on top of the other.

Advantageously, and in accordance with the preferred embodiment, the lid 50 is pivotally secured to the module 2. This is accomplished by providing two aligned cylindrical axles 52 and attaching them to the top surface 54 of the lid 50 by arms 56. Each of the axles 52 can be placed in a notch 60 (when the module 2 is assembled, the notch continues for a short distance into the side pieces 8 and 10) between one of the pairs of flanges 28A and 28C, which permits the lid 50 to be pivoted between an open position (FIG. 5) and a closed 25 position (FIG. 7). To keep the lid 50 in a horizontal orientation when closed, two stops 58 are attached the top surface 54, one across from each of the axles 52. When closed, the stops 58 rest on top of the two flanges 28A.

Although at least one preferred embodiment of the invention has been described above, this description is not limiting and is only exemplary. The scope of the invention is defined only by the claims, which follow:

What is claimed is:

1. A stackable, all-plastic module for supporting hanging file folders, comprising:

first and second leg pieces, each leg piece being a strut-reinforced unitary plastic part having a) a crosspiece having first and second ends, the crosspiece having integral reinforcing struts, b) first and second legs, each having integral reinforcing struts, extending downwardly from a corresponding one of the ends of the crosspiece, and having a lower end, c) engaging means, located on each end of the crosspiece, for mating with the lower end of a leg of another module in manner that when said lower end has been lowered into the engaging means and has been engaged thereby the leg is prevented from being horizontally displaced and permitted to be vertically raised out of the engaging means so as to be disengaged from the crosspiece, whereby the lower ends of the legs of a leg piece from another module can be removably engaged with the leg piece, d) an elongated leg piece rail dimensioned to be engaged by a hook of a hanging file folder, said leg piece rail being supported by the crosspiece and located on its top;

first and second side pieces, each side piece being a strut-reinforced unitary plastic part and having an elongated side piece rail dimensioned to be engaged by a hook of a hanging file folder, said side piece rail being supported by the side piece and being located on its top, each side piece being connected between one end of the first leg piece and one end of the second leg piece; and locking plug-and-socket connections integrally formed on the leg pieces and side pieces in a manner that the leg pieces and side pieces can be detachably secured together by directly plugging the leg pieces and side pieces together.

2. The module of claim 1, further comprising a unitary plastic lid that is detachably securable to the module.

3. The module of claim 2, wherein the lid is pivotally securable to the module.

4. The module of claim 2, wherein the lid is made of clarified polypropylene.

5. The module of claim 1, wherein the leg piece rails and the side piece rails form parts of a rectangle having letter-by-legal dimensions.

6. The module of claim 1, wherein the locking plug-and socket connections are keyed to prevent assembly in other than the intended manner.

7. The module of claim 1, wherein a caster receiving means is located at the lower end of each leg, permitting a caster to be secured thereto.

8. The module of claim 1, wherein the leg pieces and the side pieces are made of high impact polystyrene.

9. A stackable, all-plastic, rectangular module for supporting hanging file folders, comprising:

two identical leg pieces, each leg piece being a strut-reinforced a) a crosspiece having first and second ends, the crosspiece having integral reinforcing struts, b) first and second legs, each having integral reinforcing struts, extending downwardly from a corresponding one of the ends of the crosspiece, and having a lower end, and c) an elongated leg piece rail dimensioned to be engaged by a hook of a hanging file folder, said leg piece rail being supported by the crosspiece and located on its tops;

two identical side pieces, each side piece being a strut-reinforced unitary plastic part and having an elongated side piece rail dimensioned to be engaged by a hook of a hanging file folder, said side piece rail being supported by the side piece and being located on its top, each side piece being connected between one end of the first leg piece and one end of the second leg piece using plug-and socket connections in such a manner that the rails form parts of a rectangle having letter-by-legal dimensions;

locking plug-and-socket connections integrally formed on the leg pieces and side pieces in a manner that the leg pieces and side pieces can be detachably secured together by directly plugging the leg pieces and side pieces together; and engaging means, located on the top of at least two of the pieces, for mating with the lower ends of the legs of another module in a manner that when all the pieces have been assembled to form a module and said lower ends of the legs of said another module have been lowered into the engaging means and have been engaged thereby, the legs are prevented from being horizontally displaced and permitted to be vertically raised out of the engaging means so as to be disengaged from said at least two of the pieces, whereby the lower ends of the legs of said another module can be removably engaged with the assembled module, thereby permitting said another module to be removably stacked on top of said assembled module.

10. The module of claim 9, further comprising a unitary plastic lid that is hingedly secured to the module along a long edge thereof.

11. The module of claim 9, wherein each of the legs further comprises means for securing a caster thereto, and further comprising four casters, each being attached to a corresponding one of the legs.

* * * * *

UNITED STATES PATENT AND TRADEMARK OFFICE

CERTIFICATE OF CORRECTION

PATENT NO. : 6,364,133 B1
DATED : April 2, 2002
INVENTOR(S) : Sheng

It is certified that error appears in the above-identified patent and that said Letters Patent is hereby corrected as shown below:

Column 4,
Line 46, between “in” and “manner”, insert -- a --.

Column 5,
Line 24, after “strut-reinforced” and before “a)”, insert -- unitary plastic part having --.
Line 34, replace “tops” by -- top --.

Signed and Sealed this

Twenty-second Day of October, 2002

*Attest:*

*Attesting Officer*

JAMES E. ROGAN
*Director of the United States Patent and Trademark Office*